US010624476B2

(12) United States Patent
Moss

(10) Patent No.: US 10,624,476 B2
(45) Date of Patent: Apr. 21, 2020

(54) HAND PILLOW

(71) Applicant: MossCo Ventures, Inc., Pleasant Grove, UT (US)

(72) Inventor: Daniel J. Moss, Pleasant Grove, UT (US)

(73) Assignee: PATTERN, INC., Lehi, UT (US)

( * ) Notice: Subject to any disclaimer, the term of this patent is extended or adjusted under 35 U.S.C. 154(b) by 213 days.

(21) Appl. No.: 15/419,936

(22) Filed: Jan. 30, 2017

(65) Prior Publication Data

US 2017/0215608 A1 Aug. 3, 2017

Related U.S. Application Data

(63) Continuation-in-part of application No. 29/566,124, filed on May 26, 2016, now Pat. No. Des. 835,924.

(60) Provisional application No. 62/288,632, filed on Jan. 29, 2016.

(51) Int. Cl.

| | |
|---|---|
| ***A47G 9/10*** | (2006.01) |
| ***A41D 19/00*** | (2006.01) |
| ***A63H 3/14*** | (2006.01) |
| ***A63H 3/28*** | (2006.01) |

(52) U.S. Cl.

CPC ..... *A47G 9/1045* (2013.01); *A41D 19/0024* (2013.01); *A41D 19/0037* (2013.01); *A47G 9/1063* (2013.01); *A63H 3/14* (2013.01); *A63H 3/28* (2013.01)

(58) Field of Classification Search

CPC ..... A47G 9/1045; A47G 9/1063; A63H 3/28; A63H 3/14; A41D 19/0037; A41D 19/0024; A63B 71/145

See application file for complete search history.

(56) References Cited

U.S. PATENT DOCUMENTS

| | | | | | |
|---|---|---|---|---|---|
| 320,972 | A * | 6/1885 | Rumsy | A63B 71/145 2/18 |
| 2,416,444 | A * | 2/1947 | Hilton | A63B 71/145 2/18 |
| 2,574,086 | A * | 11/1951 | Broderick | A63B 71/145 2/18 |
| 3,755,820 | A | 9/1973 | Petrusek | |
| 4,417,359 | A * | 11/1983 | Johnson | A63B 71/145 2/16 |
| 4,610,640 | A * | 9/1986 | Amici | A63H 3/18 446/329 |

(Continued)

FOREIGN PATENT DOCUMENTS

| | | |
|---|---|---|
| CN | 203352237 U | 12/2013 |
| CN | ZL 201630572531.8 | 7/2017 |

OTHER PUBLICATIONS

Bumco Baby, Petumi Glove-Saks Demo, Jul. 4, 2016, https://www.youtube.com/watch?v=_OTVItODWig (Year: 2014).*

(Continued)

*Primary Examiner* — Peter M. Cuomo

*Assistant Examiner* — Myles A Throop

(74) *Attorney, Agent, or Firm* — Kunzler Bean & Adamson, PC

(57) ABSTRACT

Apparatuses, systems, and methods are disclosed for a hand pillow. A hand pillow includes a pillow and a glove. The glove is coupled to a surface of the pillow such that the pillow is worn by a user when the user puts the glove on.

14 Claims, 8 Drawing Sheets

(56) References Cited

U.S. PATENT DOCUMENTS 4,734,075 A * 3/1988 Park ..... A63H 3/12 446/321
D301,360 S 5/1989 Wells
D302,213 S 7/1989 Motazedi
5,083,314 A * 1/1992 Andujar ..... A63B 71/145 2/16
5,115,528 A * 5/1992 Lamle ..... A47G 9/1045 446/321
D348,168 S 6/1994 Keller
D348,169 S 6/1994 Keller
D348,170 S 6/1994 Keller
D348,171 S 6/1994 Keller
D348,172 S 6/1994 Keller
D348,173 S 6/1994 Keller
D348,372 S 7/1994 Keller
D369,053 S 4/1996 Keller
D372,392 S 8/1996 Bala
D375,427 S 11/1996 Yeh
D386,034 S 11/1997 Keller
D387,234 S 12/1997 Keller
D387,504 S 12/1997 Robinette
D397,900 S 9/1998 Besen
D400,664 S 11/1998 Rosenstadt et al.
D408,199 S 4/1999 Lewis et al.
D410,167 S 5/1999 Bear
5,898,938 A 5/1999 Baylor et al.
D420,237 S 2/2000 Rosenstadt et al.
6,119,267 A 9/2000 Pozzi
D434,261 S 11/2000 Rosenstadt et al.
6,216,276 B1 * 4/2001 Eibert ..... A63B 71/146 2/161.2
D461,603 S 8/2002 Oblack
6,434,769 B1 8/2002 Koenig
D462,812 S 9/2002 Quilici et al.
6,760,924 B2 7/2004 Hatch et al.
6,891,078 B1 5/2005 Dillard
7,000,259 B2 2/2006 Matechen
7,025,709 B2 4/2006 Riggall
D521,792 S 5/2006 Keller
D522,788 S 6/2006 Keller
D523,677 S 6/2006 Keller
D528,339 S 9/2006 Keller
D536,751 S 2/2007 Boutin
D545,605 S 7/2007 Keller
D547,502 S 7/2007 Mcginley
D547,587 S 7/2007 Keller
D551,889 S 10/2007 Keller
7,559,104 B1 7/2009 Kahrig
7,562,398 B2 7/2009 Beland et al.
7,682,324 B2 3/2010 Pillari
D622,911 S 8/2010 Full
D636,212 S * 4/2011 Carlucci ..... D6/601
8,062,087 B1 * 11/2011 Davis ..... A63H 3/003 446/26
D650,538 S 12/2011 Anderson
D660,069 S 5/2012 Beuerle
8,230,522 B1 * 7/2012 Bell ..... A41D 19/0037 2/160
D670,123 S 11/2012 Beuerle
D672,995 S 12/2012 Diaz
D680,787 S 4/2013 Diaz
8,839,472 B2 9/2014 Ferrell
D728,968 S 5/2015 Pfaff
D728,969 S 5/2015 Pfaff
D765,811 S 9/2016 Zipf
D775,696 S 1/2017 Zipf
D790,252 S * 6/2017 Brown ..... D6/601
D835,924 S * 12/2018 Moss ..... D6/598
2002/0124315 A1 9/2002 Clarke et al.
2002/0144351 A1 10/2002 Fujii
2003/0135926 A1 7/2003 Ong
2004/0123372 A1 7/2004 Kleinert
2006/0221599 A1 * 10/2006 Hornsby ..... A47B 97/00 362/127
2008/0104737 A1 5/2008 Shepherd
2010/0027807 A1 * 2/2010 Jeon ..... H03G 7/002 381/74
2011/0088131 A1 * 4/2011 McVan ..... A63B 69/0084 2/18
2011/0220634 A1 * 9/2011 Yeh ..... A43B 3/0005 219/482
2012/0329357 A1 12/2012 Brodess
2013/0025060 A1 * 1/2013 Shull ..... A47G 9/10 5/646
2013/0074245 A1 * 3/2013 Cardi ..... A42B 1/245 2/172
2013/0079584 A1 * 3/2013 Armbruster ..... A61M 21/02 600/28
2013/0287971 A1 10/2013 Caldwell
2013/0312180 A1 * 11/2013 Moran ..... A47G 9/10 5/490
2015/0121625 A1 * 5/2015 Myers ..... A47C 21/00 5/636

OTHER PUBLICATIONS

U.S. Appl. No. 29/566,124 Final Office Action dated Sep. 21, 2017.
U.S. Appl. No. 29/566,124 Office Action dated Mar. 8, 2018.
U.S. Appl. No. 29/566,124 Notice of Allowance dated Jul. 25, 2018.
Chinese Patent Application No. 201630572531.8 Notice of Allowance dated Apr. 28, 2017.
Mini Glove Pillow Snapping Pillow by Evefy, https://www.amazon.com/Mini-Glove-Pillow-Snapping/dp/B019TTE6JS, retrieved Mar. 25, 2016.
U.S. Appl. No. 291566,124 Office Action dated Mar. 23, 2017.

* cited by examiner

HAND PILLOW

CROSS-REFERENCES TO RELATED APPLICATIONS

This application claims the benefit of U.S. Provisional Patent Application No. 62/288,632 entitled "HAND PILLOW" and filed on Jan. 29, 2016, for Dan Moss, which is incorporated herein by reference. This application also claims the benefit of U.S. Design Pat. Application No. 29/566,124 entitled "HAND PILLOW" and filed on May 26, 2016, for Daniel J. Moss, which is incorporated herein by reference.

FIELD

This invention relates to pillows and more particularly relates to hand pillows.

BACKGROUND

Pillows can be used to support a person's head/neck, or other parts of the body, while the person is sleeping, lying down, sitting, or otherwise resting. However, in some situations it may be difficult for a person to comfortably use a pillow, such as in a car, at a desk, or the like.

SUMMARY

A hand pillow, in one embodiment, is disclosed that includes a pillow and a glove. In one embodiment, the glove is coupled to a surface of the pillow such that the pillow is worn by a user when the user puts the glove on. In a further embodiment, the glove is selectively coupleable to the pillow such that the pillow is detachable from the glove. In some embodiments, the glove is selectively coupleable to the pillow using one or more fasteners, which may include magnets, hook-and loop fasteners, snaps, clips, buttons, and zippers.

In a further embodiment, the glove is fastened to the pillow using one or more fasteners, which may include stitching and adhesives. In certain embodiments, the pillow is made of a compressible material and the glove is made of an elastic material such that the pillow can be folded into the inside of the glove when the glove is turned inside-out.

In one embodiment, the hand pillow further comprises a wireless speaker configured to connect wirelessly with an electronic device for streaming audio from the electronic device. In certain embodiments, the hand pillow further comprises one or more lights on a surface of the pillow. In various embodiments, the pillow comprises a stuffed animal, which may include one or more parts attached to the pillow that resemble one or more characteristics of the stuffed animal. In certain embodiments, the pillow comprises one or more pockets. In one embodiment, the pillow comprises a charger for an electronic device. In some embodiments, the glove comprises a mitten.

A method, in one embodiment, includes providing a pillow, providing a glove, and coupling the glove to a surface of the pillow such that the pillow is worn by a user when the user puts the glove on. In a further embodiment, the method includes selectively coupling the glove to the pillow such that the pillow is detachable from the glove. In some embodiments, the glove is selectively coupleable to the pillow using one or more fasteners, which may include magnets, hook-and loop fasteners, snaps, clips, buttons, and zippers.

In certain embodiments, the method includes fastening the glove to the pillow using one or more fasteners, which may include stitching and adhesives. In one embodiment, the pillow is made of a compressible material and the glove is made of an elastic material such that the pillow can be folded into the inside of the glove when the glove is turned inside-out.

In a further embodiment, the pillow further comprises a wireless speaker configured to connect wirelessly with an electronic device for streaming audio from the electronic device. In certain embodiments, the pillow further comprises one or more lights on a surface of the pillow. In some embodiments, the pillow comprises a stuffed animal, which may include one or more parts attached to the pillow that resemble one or more characteristics of the stuffed animal.

A hand pillow, in one embodiment, includes a pillow, a glove, and means for coupling the glove to a surface of the pillow such that the pillow is worn by a user when the user puts the glove on.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention, and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Disclosed is a hand pillow that may also be used as a plush toy. A flexible glove may be attached to the bottom of the plush toy pillow so it can easily be used while holding onto something else, such as handlebars on a bike, or a luggage handle. When a user lays his hands on the ground, the user may rest his head on the pillow on top of their hand.

Figure 1:
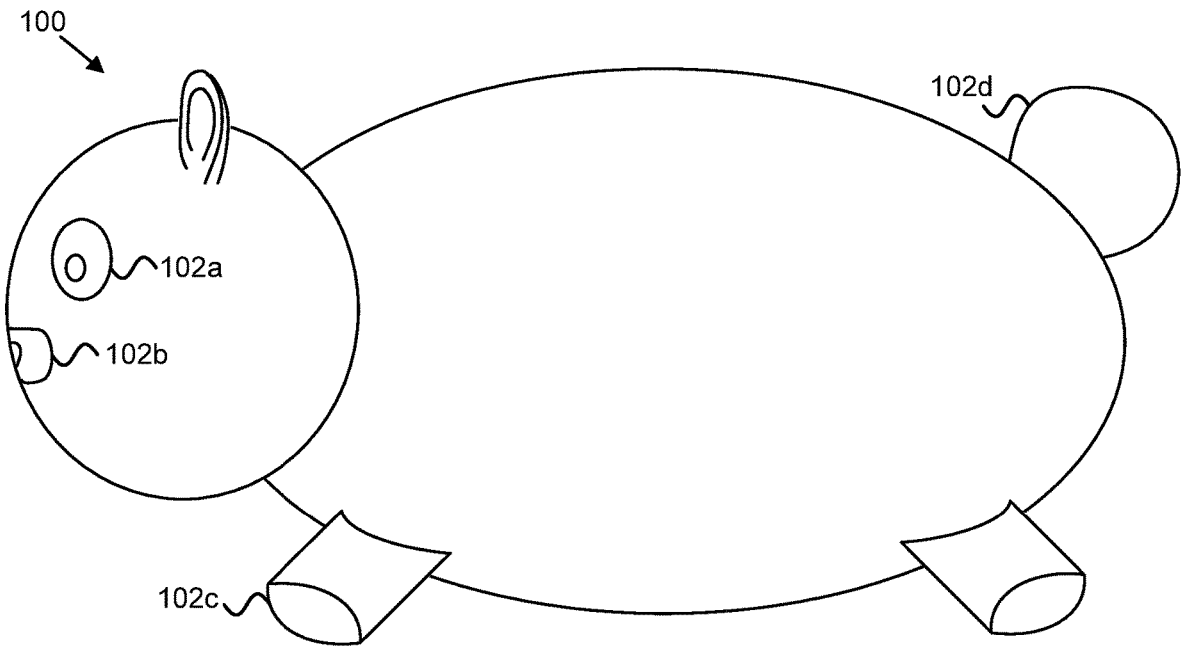
FIG. 1 is a depiction of one embodiment of a pillow in accordance with the subject matter described herein.

FIG. 1 depicts one embodiment of a pillow 100. In the depicted embodiment, the pillow 100 may be embodied as a stuffed animal, or other plush toy. In other embodiments, the pillow 100 may be a simple pillow 100 without the decorative elements 102*a-d*. One of skill in the art, in light of this disclosure, will recognize that the pillow 100 may have various shapes, sizes, colors, features, and/or the like. The pillow 100, in one embodiment, is a substantially plush or soft pillow. The pillow 100 may be filled with various soft materials, such as cotton batting, expanded polystyrene (e.g., Styrofoam®), and/or the like.

The pillow 100, in some embodiments, may be configured to contain air such that the pillow 100 is inflatable and deflateable. For example, a user may blow air into the pillow 100 to inflate the pillow 100 using their mouths, a bike pump, and/or the like. The pillow 100 may be made of various types of materials including fabrics (e.g., cotton, wool, polyester, silk, or the like), soft plastics, vinyl, leather, and/or the like. The pillow 100 may be embodied as a stuffed animal, as depicted in FIG. 1, and may be made to resemble various items/objects such as insects, animals, airplanes, cars, trains, sports items, and/or the like. In such an embodiment, the pillow 100 may include parts 102*a-d* attached to the pillow to resemble eyes, legs, wheels, tails, and/or the like using fabric, plastic, and/or the like. In some embodiments, the pillow 100 may be used as a plush toy for children.

The pillow 100 may include lights on the outside surface of the pillow 100 that may be selectively turned on and off using a control on the inside and/or outside of the pillow 100, such as a switch, button, voice control, motion control, or the like. Similarly, the pillow 100 may include lights located on the inside of the pillow 100 that provide an ambient lighting effect when turned on (e.g., such as a night light), and which may be selectively turned on and off using a control on the inside and/or outside of the pillow 100. The pillow 100 may include components on the outside of the pillow 100 that create sounds when pressed. For example, a pillow 100 that is shaped like a bear and includes a bear's eyes, mouth, nose, and/or the like may generate various sounds when the pillow 100 is squeezed, when the nose is pressed, when the tail is pulled, and/or the like. The pillow 100 may also include one or more pockets for storing items such as toys, snacks, electronic devices, and/or the like that may be secured using hook-and-loop fasteners, zippers, snaps, and/or the like.

Figure 2:
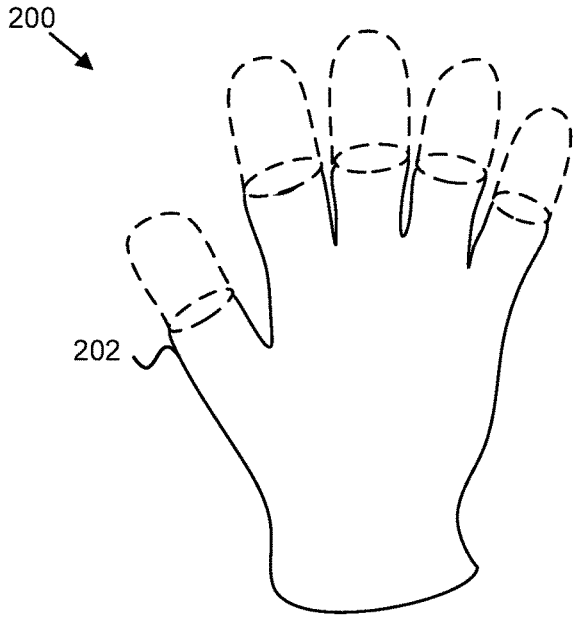
FIG. 2 is a depiction of one embodiment of a glove in accordance with the subject matter described herein.

In various embodiments, the pillow 100 is coupleable to a glove 200, which is depicted in FIG. 2. In certain embodiments, the pillow 100 is selectively and/or removably coupleable to a glove 200, at the top or the bottom of the glove 200, such that the pillow 100 can be attached and detached from the glove 200. For instance, the pillow 100 may be selectively coupled to the glove 200 using various fasteners such as magnets, hook-and-loop fasteners (e.g., Velcro®), snaps, clips, buttons, zippers, and/or the like. In this manner, the glove 200 may be coupled to the pillow 100 at various points on the surface of the pillow 100, such as the bottom surface, the top surface, a side surface, or the like. In one embodiment, the pillow 100 is permanently attached or fastened to the glove 200, at the top or the bottom of the glove 200, by being sewn to the glove 200, adhered to the glove 200 (e.g., using glue and/or another adhesive), and/or the like. In this manner, a user can place his/her hand in the glove and position the pillow 100 in a comfortable position for his/her head, for example.

FIG. 2 depicts one embodiment of a glove 200 that is configured to be coupled to the pillow 100 depicted in FIG. 1. The glove 200 may be made of a substantially soft, flexible, stretchable, and/or breathable material such as fabric, leather, and/or the like. The glove 200 may accommodate various hand sizes. The glove 200 may include an adjustment mechanism, such as a resizable band, to secure the glove 200 to a hand. The fingers 202 of the glove 200 may be open or closed. For example, the tips of the fingers 202 of the glove may be cut off so that the user's finger tips are exposed while the glove is worn. The glove 200 may be ambidextrous so that the glove 200 may accommodate left- and right-handed users. The glove 200 may also be embodied as a mitten such that the glove does not include separate fingers 202, except for the thumb, in certain embodiments.

In one embodiment, the pillow 100 may be made of a substantially compressible material, and the glove 200 may be made of a substantially elastic material, such that the pillow 100 can be folded into the inside of the glove 200 when the glove 200 is turned inside-out. In a further embodiment, the pillow 100 and/or the glove 200 may include a Bluetooth® speaker, or other wireless speaker, that can connect to, and stream audio from, an electronic device such as a smart phone, a tablet computer, a car-audio sound system, a laptop, and/or the like. In such an embodiment, the pillow 100 may include one or more headphone jacks for connecting headphones to the pillow 100 and streaming audio received via Bluetooth® to the headphones. In a further embodiment, the pillow 100 may include a speaker integrated with an upper surface of the pillow, such that the integrated speaker is aligned with and/or is near a wearer's ear when the wearer lays on the pillow. The headphones and/or integrated speaker, in certain embodiments, may comprise volume limiting circuitry to prevent damage to children's ears from loud noises. Volume limiting circuitry, in one embodiment, may be selectively be enabled and/or set at a selectable volume level (e.g., by a parent of the wearer, or the like). The pillow 100 and/or the glove 200, in various embodiments, may include a pocket for a mobile device, such as a smart phone, and also a wired and/or wireless charger for the mobile device. In such an embodiment, the wired and/or wireless charger may be connected to the same battery as a Bluetooth® speaker included in the pillow 100.

Figure 3A:
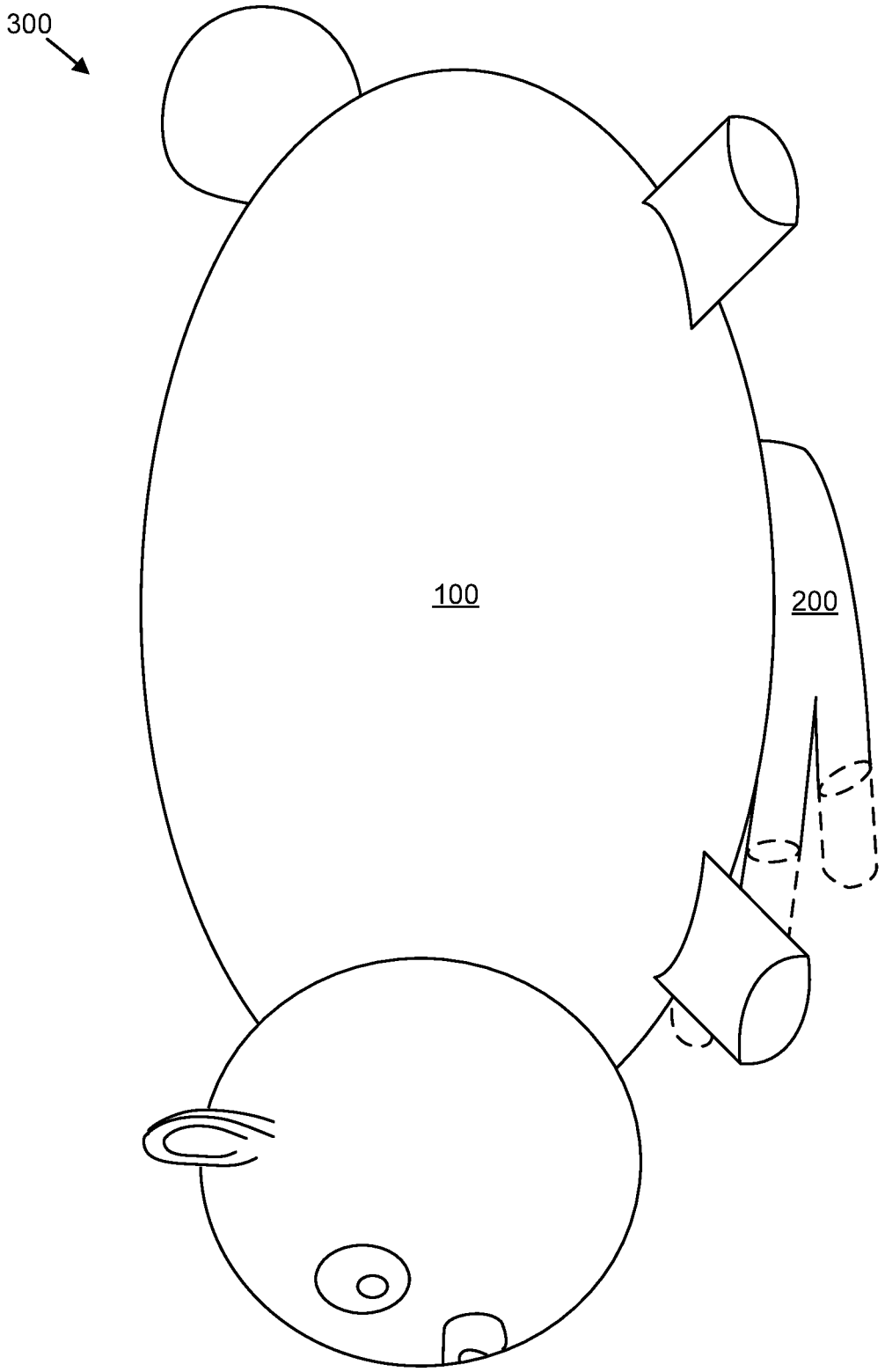
FIGS. 3A-3F are depictions of various views of an embodiment of a hand pillow in accordance with the subject matter described herein.

FIG. 3A depicts a side view of an embodiment of a hand pillow 100 described above with reference to FIGS. 1 and 2. As shown in FIG. 3A, the glove 200 is coupled to the pillow 100 on the underside of the pillow 100 so that a user can put the glove 200 on a hand and rest his head on the pillow 100, for example.

Figure 3B:
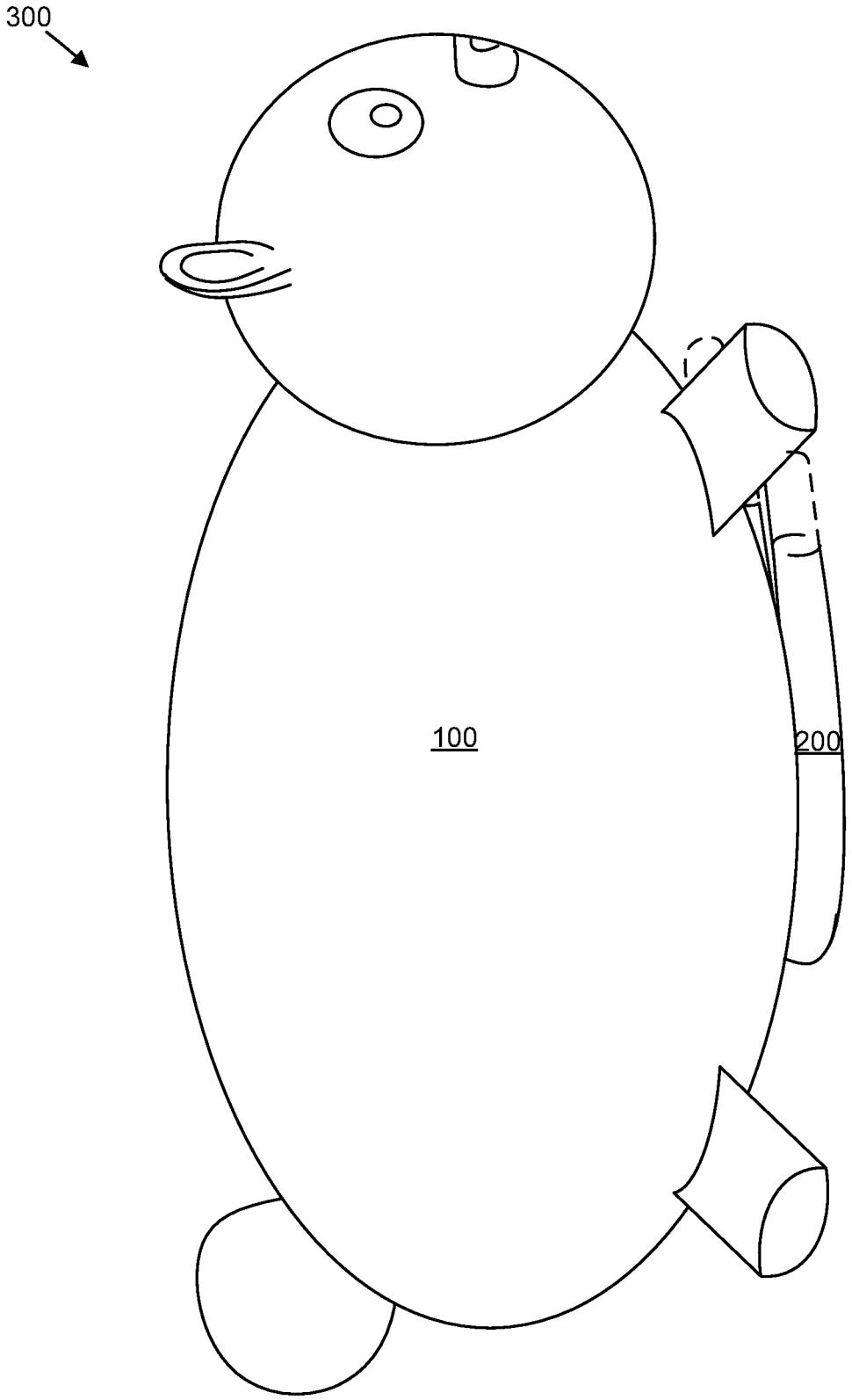

FIG. 3B depicts another side view of an embodiment of a hand pillow 100 described above with reference to FIGS. 1 and 2. FIG. 3B may be the opposite side view of the side view presented in FIG. 3A where the glove 200 is coupled to the pillow 100 on the underside of the pillow 100.

Figure 3C:
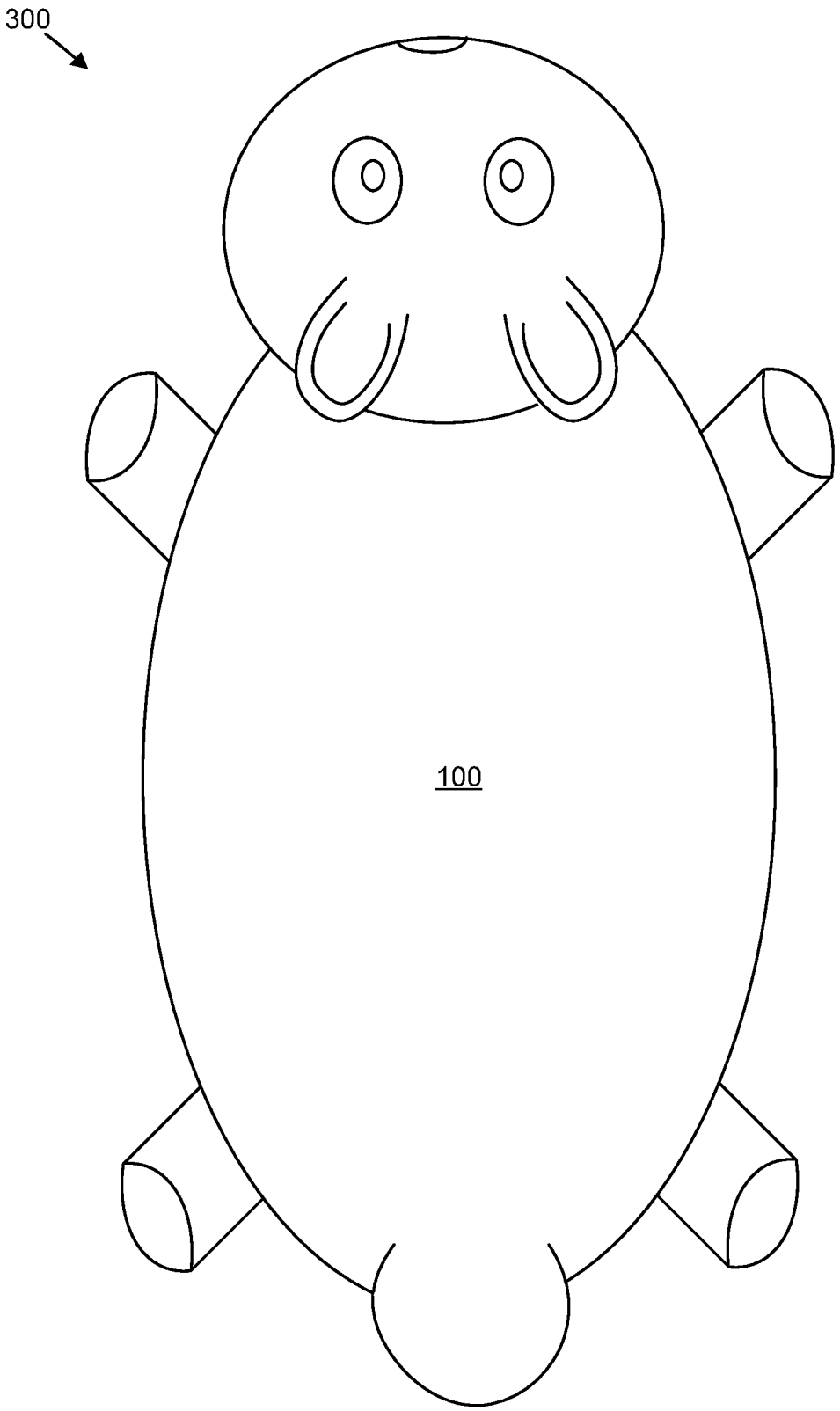

FIG. 3C depicts a top view of an embodiment of a hand pillow 100 described above with reference to FIGS. 1 and 2. FIG. 3C may be a top view of the hand pillow 100 presented in FIGS. 3A-3B where the glove 200 is coupled to the pillow 100 on the underside of the pillow 100.

Figure 3D:
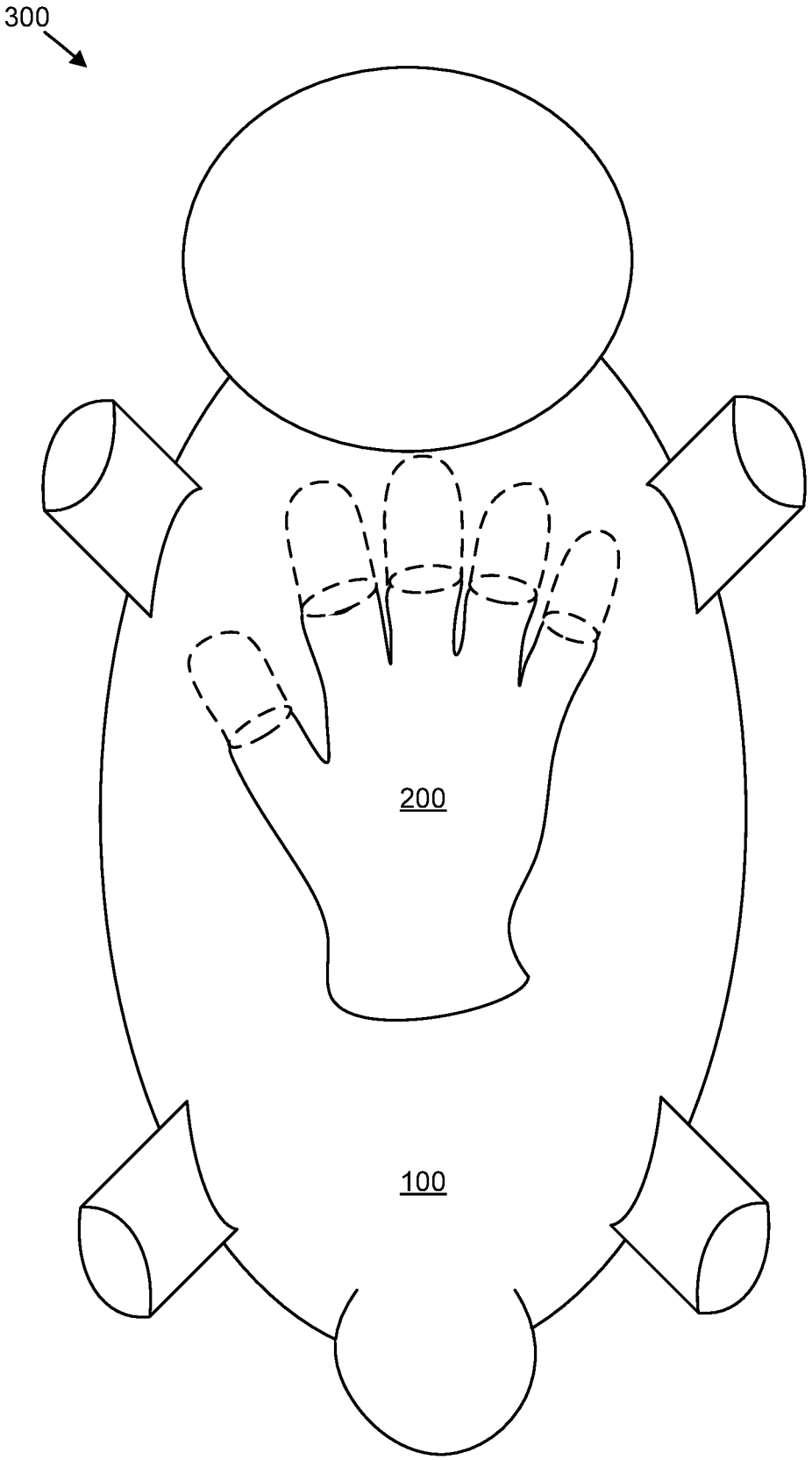

FIG. 3D depicts a bottom view of an embodiment of a hand pillow 100 described above with reference to FIGS. 1 and 2. FIG. 3D may be a bottom view of the hand pillow 100 presented in FIGS. 3A-3C where the glove 200 is coupled to the pillow 100 on the underside of the pillow 100.

Figure 3E:
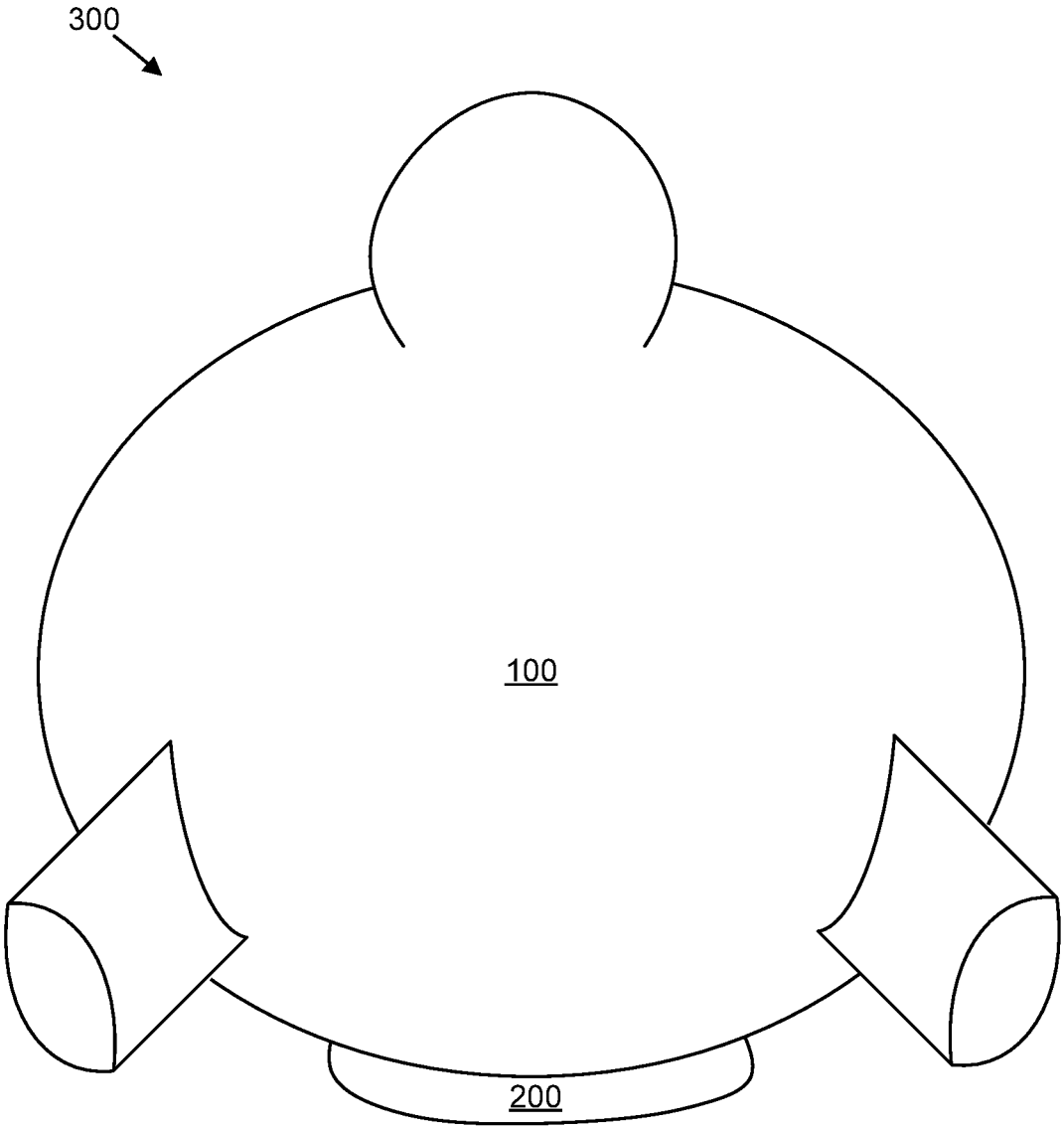

FIG. 3E depicts a back view of an embodiment of a hand pillow 100 described above with reference to FIGS. 1 and 2. FIG. 3E may be a back view of the hand pillow 100 presented in FIGS. 3A-3D where the glove 200 is coupled to the pillow 100 on the underside of the pillow 100.

Figure 3F:
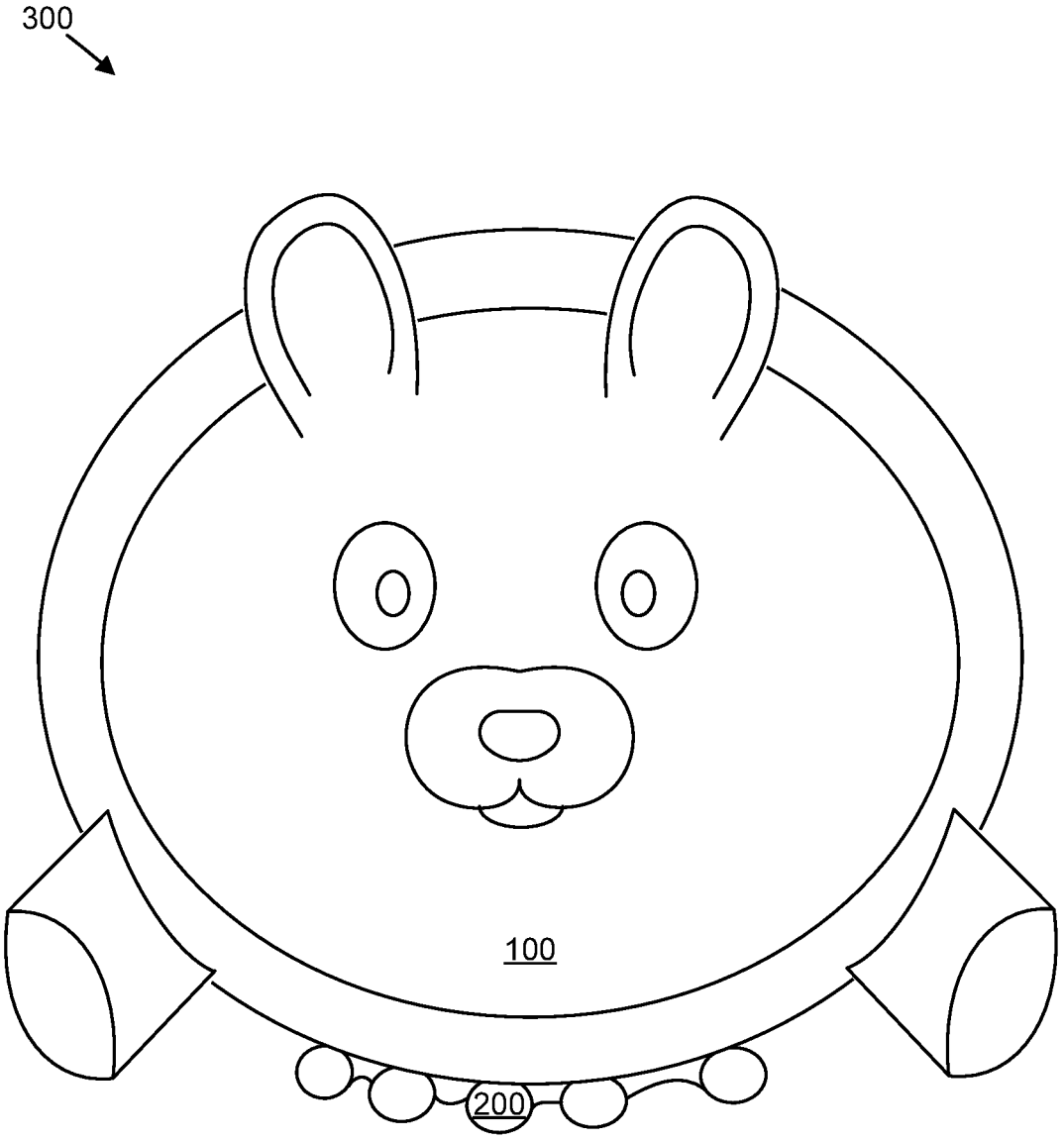

FIG. 3F depicts a side view of an embodiment of a hand pillow 100 described above with reference to FIGS. 1 and 2. FIG. 3F may be a front view of the hand pillow 100 presented in FIGS. 3A-3D where the glove 200 is coupled to the pillow 100 on the underside of the pillow 100.

Figure 4:
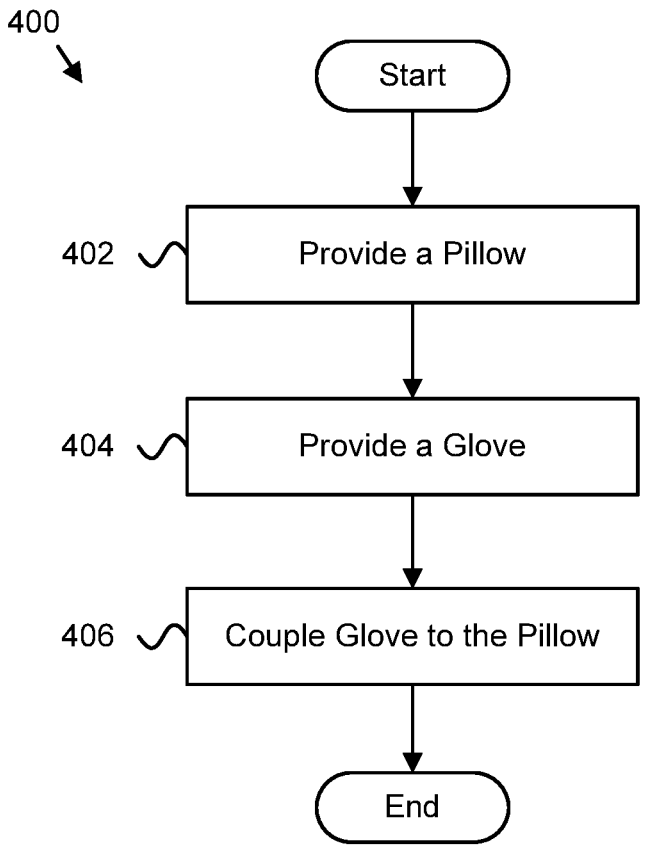
FIG. 4 is a schematic flow chart diagram illustrating one embodiment of a method for manufacturing a hand pillow in accordance with the subject matter described herein.

FIG. 4 is a schematic flow-chart diagram for a method 400 for manufacturing a hand pillow 100. In one embodiment, the method 400 begins and provides 402 a pillow 100, such as the pillow 100 described above with reference to FIGS. 1 and 3A-3F. In a further embodiment, the method 400 provides 404 a glove 200, such as the glove 200 described above with reference to FIGS. 2 and 3A-3F. In certain embodiments, the method 400 couples 406 the provided glove 200 to the provided pillow 100. The glove 200 may be coupled to a top or bottom side of the pillow 100, for example, and may be coupled to the pillow 100 using various fasteners such as hook-and-loop fasteners, snaps, buttons, stitching, adhesives, and/or the like, and the method 400 ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hand pillow comprising:

a pillow, the pillow comprising one or more pockets attached to a surface of the pillow, the pillow made of a compressible material;

one or more lights on an outside surface of the pillow, the one or more lights controllable to selectively turn on and off a speaker integrated with an upper surface of the pillow such that the speaker is aligned with a user's ear when the user lays on the pillow, the speaker comprising volume limiting circuitry that limits a volume level of the speaker to a specific volume level; and a glove permanently fastened to a bottom surface of the pillow such that the pillow is worn by a user when the user puts the glove on, the glove made of an elastic material, the glove comprising:

a plurality of fingers that have open ends for exposing the user's finger tips while the user wears the glove; and an adjustment mechanism for adjusting a size of the glove to secure the glove to the user's hand, wherein the pillow is insertable into an inside of the glove when the glove is turned inside-out.

2. The hand pillow of claim 1, wherein the glove is permanently fastened to the pillow using one or more fasteners, the one or more fasteners selected from the group consisting of stitching and permanent adhesives.

3. The hand pillow of claim 1, wherein the hand pillow further comprises a wireless speaker configured to connect wirelessly with an electronic device for streaming audio from the electronic device.

4. The hand pillow of claim 1, wherein the hand pillow further comprises one or more lights on a surface of the pillow.

5. The hand pillow of claim 1, wherein the pillow comprises a stuffed animal, the stuffed animal comprising one or more parts attached to the pillow that resemble one or more characteristics of the stuffed animal.

6. The hand pillow of claim 1, wherein the pillow comprises one or more pockets.

7. The hand pillow of claim 1, wherein the pillow comprises a charger for an electronic device.

8. The hand pillow of claim 1, wherein the glove comprises a mitten.

9. A method comprising:

providing a pillow made of compressible material, the pillow comprising:

one or more pockets attached to a surface of the pillow;

one or more lights on an outside surface of the pillow, the one or more lights controllable to selectively turn on and off; and a speaker integrated with an upper surface of the pillow such that the speaker is aligned with a user's ear when the user lays on the pillow, the speaker comprising volume limiting circuitry that limits a volume level of the speaker to a specific volume level;

providing a glove made of an elastic material, the glove comprising:

a plurality of fingers that have open ends for exposing the user's finger tips while the user wears the glove; and an adjustment mechanism for adjusting a size of the glove to secure the glove to the user's hand; and permanently fastening the glove to a bottom surface of the pillow such that the pillow is worn by a user when the user puts the glove on, wherein the pillow is insertable into an inside of the glove when the glove is turned inside-out.

10. The method of claim 9, wherein the glove is permanently fastened to the pillow using one or more fasteners, the one or more fasteners selected from the group consisting of stitching and permanent adhesives.

11. The method of claim 9, wherein the pillow further comprises a wireless speaker configured to connect wirelessly with an electronic device for streaming audio from the electronic device.

12. The method of claim 9, wherein the pillow further comprises one or more lights on a surface of the pillow.

13. The method of claim 9, wherein the pillow comprises a stuffed animal, the stuffed animal comprising one or more parts attached to the pillow that resemble one or more characteristics of the stuffed animal.

14. A hand pillow comprising:

a pillow made of compressible material, the pillow comprising:

one or more pockets attached to a surface of the pillow;

one or more lights on an outside surface of the pillow, the one or more lights controllable to selectively turn on and off; and a speaker integrated with an upper surface of the pillow such that the speaker is aligned with a user's ear when the user lays on the pillow, the speaker comprising volume limiting circuitry that limits a volume level of the speaker to a specific volume level;

a glove made of an elastic material, the glove comprising:

a plurality of fingers that have open ends for exposing the user's finger tips while the user wears the glove; and an adjustment mechanism for adjusting a size of the glove to secure the glove to the user's hand; and means for permanently fastening the glove to a bottom surface of the pillow such that the pillow is worn by a user when the user puts the glove on, wherein the pillow is insertable into an inside of the glove when the glove is turned inside-out.

* * * * *